US006260736B1

(12) United States Patent
Adams et al.

(10) Patent No.: US 6,260,736 B1
(45) Date of Patent: Jul. 17, 2001

(54) CONDIMENT PUMP

(76) Inventors: Rodney W. Adams, 309 Old Darby La., Winthrop Harbor, IL (US) 60096; Alan G. Hale, 11833 W. 9th St., Zion, IL (US) 60099

( * ) Notice: Subject to any disclaimer, the term of this patent is extended or adjusted under 35 U.S.C. 154(b) by 0 days.

(21) Appl. No.: 09/457,143

(22) Filed: Dec. 9, 1999

(51) Int. Cl.[7] ..... B67D 5/40

(52) U.S. Cl. ..... 222/383.1; 222/385; 417/552; 417/555

(58) Field of Search ..... 222/383.1, 382, 222/105, 95, 385; 417/552, 554, 555.1

(56) References Cited

U.S. PATENT DOCUMENTS

| | | | | |
|---|---|---|---|---|
| 3,730,398 | * | 5/1973 | Goda | 222/385 |
| 5,375,746 | * | 12/1994 | Schaefer et al. | 222/385 |
| 5,381,932 | * | 1/1995 | Humphrey | 222/321 |
| 5,579,959 | * | 12/1996 | Bennett et al. | 222/385 |
| 6,019,256 | * | 2/2000 | Seltzer | 222/383.1 |

* cited by examiner

*Primary Examiner*—Kevin Shaver
*Assistant Examiner*—David Deal

(57) ABSTRACT

A condiment pumping system for dispensing food products from a dispensing chamber by the operation of a piston assembly which during the dispensing action the dispensing chamber is refilled and during the return stroke of the piston assembly the food product is transferred to the driving side of the piston assembly to facilitate a subsequent dispensing action.

4 Claims, 1 Drawing Sheet

CONDIMENT PUMP

BACKGROUND OF THE INVENTION

The dispensing of condiments and other sauces have long been done by the use of hand operated pumps that are controlled by using the force generated by the operator to force product from a cylinder out of a tube to a dispensing nozzle. This action takes place in opposition to a spring that acts to force the pump handle in an outward direction. When the dispensing stroke is finished and the handle released, the previously compressed spring returns the handle to the start position and refills the cylinder by generating a partial vacuum to suck product from a reservoir. The reservoir is typically a crock with a lid where the pump is mounted. The total lift of the product is generally less than 12 inches. This lift as well as other factors like the pump's construction determines the strength of the spring required. This type of dispensing pump is and has been used to dispense not only condiments but other sauces like toppings on desserts, cheese sauce etc.

These pumps are typically required to be cleaned every day as the crevices and small openings become convenient locations for bacterial contamination and product build up. Disassembly of the component parts is sometimes required during the approved cleaning procedure. This process is prone to such difficulties as losing some of the pieces or faulty reassembly of the pump, resulting in premature failure. The mating surfaces of the pump are areas where constant disassembly and reassembly is most likely to cause future problems.

Recently the use of condiments packed in a flexible bag format typically referred to as a "BIG-IN-BOX" has increased. This format has several advantages over traditional packaging formats. Sanitation is the prime motivator for using this type of format. Unfortunately "bag-in-box" condiments have required relatively complicated and expensive systems to dispense the product.

Attempts to use "Hand Pumps" and Bag-In-Box formats together have met with limited success. Most have used existing hand pump designs adapted to pump from a bag. The reason these fail to operate effectively is due to the action of the spring being regulated to pull condiment from the bag after the dispensing stroke is complete. The spring can fill the pump quickly when it is immediately above a crock but will fill slowly when required to pull condiment from a bag at a remote condition only a few feet away. This increase in fill time limits the use of this type of system.

It can be appreciated that there exists a need for a pumping mechanism that can be used to readily pull product from remote locations and quickly refill dispensing chambers. Also it is essential that the mechanism be easily cleaned and sanitized.

SUMMARY OF THE INVENTION

In accordance with the present invention there is provided a pumping mechanism that can readily be substituted for a typical hand pump and also utilized with a bag-in-box format. The novel pumping mechanism can be quickly refilled during the dispensing action and does not require that the spring used for retracting the handle be located in the dispensing chamber and complicate cleaning problems. With essentially flat surface areas in the pump it can be readily cleaned and sanitized by providing a suitable fitment in the inlet chamber of the pump which is connected to a source of cleaning fluid.

The novel valving mechanism is located in the dispensing chamber whereby when the pump handle is moved in the dispensing direction a piston assembly will drive liquid in the dispensing chamber out through a dispensing nozzle. During the dispensing handle movement the dispensing chamber on the backside of the piston is being refilled from the inlet chamber. When the piston assembly is withdrawn the valve normally closing an opening in the piston is opened to permit liquid to flow through the piston to the front side of the piston to reload the dispensing chamber.

As will be noted there is nothing in the various chambers to prevent cleaning of the pump when a sanitizing liquid is forced through the pump during the cleaning action. The spring for normally biasing the handle in an outwardly direction is located outside of the condiment chambers and thus does not serve as a source of possible contamination.

These and other objects, features and advantages of the present invention will become apparent from the following description.

DETAILED DESCRIPTION OF THE PREFERRED EMBODIMENT

Figure 1:
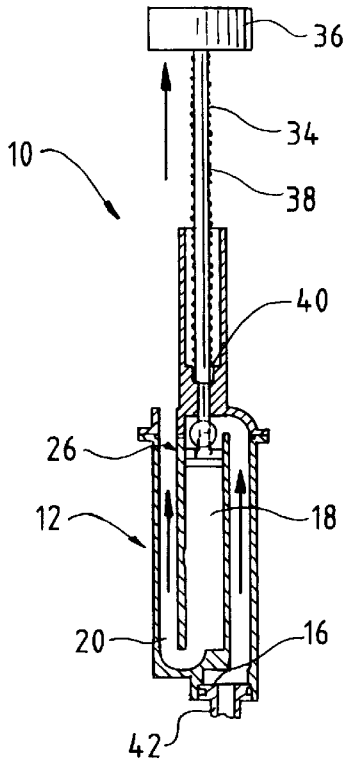
FIG. 1 is a cross section view of the novel pump showing the piston assembly in the raised position.

The present invention as shown in FIG. 1 constitutes a novel condiment pump 10 comprising a housing 12. Located within the housing 12 is an inlet chamber 14 into which a condiment flows through a one-way valve 16. Centrally of the valve is located a dispensing chamber 18, the bottom of which communicates with an outlet chamber 20 leading to a dispensing nozzle 22.

Disposed within the dispensing chamber is a piston assembly 24 consisting of a piston 26 to which is connected a yoke 28. The piston 26 includes a central opening 30 that is closed by a ball valve 32 contacting the valve seat 33 during the dispensing stroke though the action of a rod 34 connected to the ball valve 32.

Figure 4:
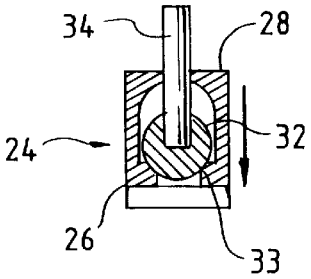
FIGS. 4 and 5 are front and side views of the piston assembly during the dispensing stroke.
Figure 5:
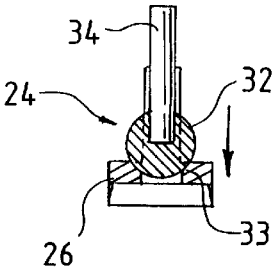

The dispensing stroke illustrated in FIGS. 4 and 5 shows the ball valve 32 within the yoke 28 and engaging the valve seat.

Figure 2:
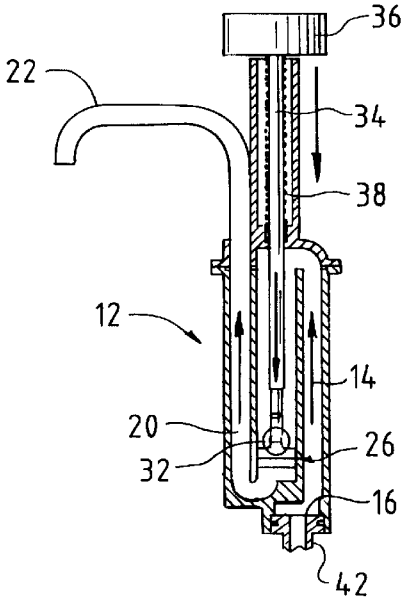
FIG. 2 is a cross sectional view of the pump with the piston assembly in its lowered or dispensing position.
Figure 3:
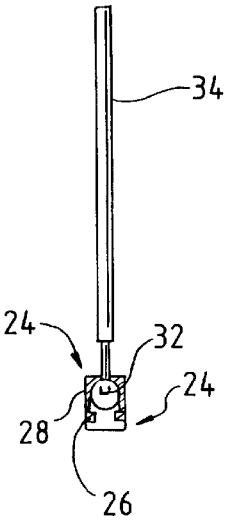
FIG. 3 illustrates the rod and piston assembly.

During the dispensing action as shown in FIG. 2 liquid condiment flows out of the dispensing chamber into the outlet chamber 20 and out through the dispensing nozzle 22.

Figure 6:
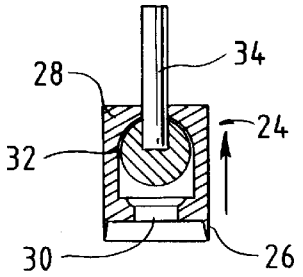
FIGS. 6 and 7 are front and side views of the piston assembly during the return stroke.
Figure 7:
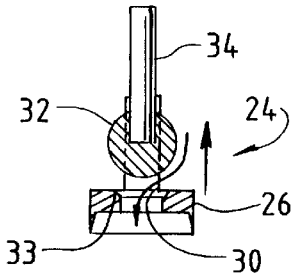

During the return stroke shown in FIGS. 6 and 7 the ball valve 32 is moved upward by the spring adjusted rod and engages the upper part of the yoke 28 and thus opens the port 30 in piston 28. This permits condiments to flow through opening 30 to refill the dispensing chamber located underneath the piston as the piston raises to its uppermost position as shown in FIG. 1.

The piston is assembly is normally biased to its uppermost position as shown in FIG. 1 by the compression spring 38 located between the housing wall 40 and handle 36.

OPERATION

Prior to operating the pump 10 it is primed by filling all the chambers 14, 18 and 10 and dispensing nozzle 22 of the pump with condiment. The pump components will be in the position shown in FIG. 1. When condiment is to be dispensed, the handle 36 pushes rod 34 downwardly against the action of the spring 38 to initially move the ball valve 32 against the piston 26 to close the opening 30. Further downward movement of rod 34 moves the piston assembly (ball valve 32, yoke 28 and piston 26) downwardly to force the condiment out from inlet chamber 14 to dispense liquid from the outlet chamber 20 and dispensing nozzle 22. During the dispensing action, condiment flows from the inlet chamber into the dispensing chamber above the piston assembly.

When dispensing is completed the handle and rod is moved upwardly by spring 38 to disengage the ball valve from the piston opening 30 (see FIG. 6). The ball valve 22 then engages the yoke to retract the piston 26. During this upward movement condiment flows from the backside of the piston through the opening 30 to refill the dispensing chamber. This cycle is repeated to continue to dispense condiment whenever desired.

It can be appreciated that the pump will remain filled at all times thus making for quick and efficient operation.

CLEANING

When it is desired to clean the pump a sanitizing solution under high pressure is admitted through an inlet fitment 42 connected to the inlet of the inlet chamber 14.

It is intended to cover by the appended claims all modifications and embodiments that fill within the true spirit and scope of the invention.

What is claimed:

1. A pump for dispensing food products such as a condimnent comprising an inlet chamber for receiving a condiment, a dispensing chamber in communication with said inlet chamber, and an outlet chamber in communication with a dispensing spout, a piston assembly in said dispensing chamber defining an opening through which condiment may flow when being raised and a valve means for closing oil the opening when it is being lowered means for normally biasing the piston to its raised position whereby when the piston assembly is raised the piston will be drawn through the product and when it is lowered condiment will be forced out of said dispensing chamber from where it will be dispensed, and the dispensing chamber is being refilled.

2. A pump as set forth in claim 1 in which the valve means includes a ball valve for controlling the opening and a rod means secured to said ball whereby when the rod is raised the ball valve will withdraw from the opening to permit the flow of condiment therethrough and when the rod is lowered the ball valve will close said opening to force condiment out of said dispensing chamber into said outlet chamber.

3. A pump as set forth in claim 2 which includes a housing and spring means disposed between said housing and said rod means for normally biasing the rod means into its withdrawn position.

4. A pump in accordance with claim 2 in which the piston assembly includes a yoke portion that surrounds the opening, which restrains the ball valve in its raised position relative to the opening in the piston assembly while permitting the flow of condiment past the ball valve into the dispensing chamber.

* * * * *